US011590497B2

(12) United States Patent
Mikaelian

(10) Patent No.: US 11,590,497 B2
(45) Date of Patent: Feb. 28, 2023

(54) PASSIVE FLUIDIC CONNECTION BETWEEN TWO HYDROPHILIC SUBSTRATES

(71) Applicant: IMEC VZW, Leuven (BE)

(72) Inventor: David Mikaelian, Brussels (BE)

(73) Assignee: IMEC VZW, Leuven (BE)

( * ) Notice: Subject to any disclaimer, the term of this patent is extended or adjusted under 35 U.S.C. 154(b) by 204 days.

(21) Appl. No.: 16/914,771

(22) Filed: Jun. 29, 2020

(65) Prior Publication Data

US 2021/0016278 A1 Jan. 21, 2021

(30) Foreign Application Priority Data

Jul. 16, 2019 (EP) ..... 19186465

(51) Int. Cl.
*B01L 3/00* (2006.01)

(52) U.S. Cl.
CPC . *B01L 3/502715* (2013.01); *B01L 2300/0636* (2013.01); *B01L 2300/165* (2013.01); *B01L 2400/0406* (2013.01)

(58) Field of Classification Search
CPC .. B01L 3/502715; B01L 3/5027; B01L 3/502; B01L 3/50; B01L 2300/0636; B01L 2300/165; B01L 2400/0406
USPC ..... 422/50
See application file for complete search history.

(56) References Cited

U.S. PATENT DOCUMENTS

2003/0039585 A1 2/2003 Freeman
2005/0226779 A1* 10/2005 Oldham ..... B01L 3/50851 422/400
2008/0000536 A1 1/2008 Delamarche et al.
2009/0305326 A1 12/2009 Beebe et al.
2010/0054992 A1 3/2010 Ohmiya et al.
2015/0314283 A1 11/2015 Verhoeckx et al.
(Continued)

OTHER PUBLICATIONS

Extended European Search Report, from the European Patent Office, for EP Patent Application No. 19186465.1, dated Nov. 11, 2019, pp. 1-7.

(Continued)

*Primary Examiner* — Christine T Mui

(74) *Attorney, Agent, or Firm* — McDonnell Boehnen Hulbert & Berghoff LLP

(57) ABSTRACT

A capillary driven microfluidic system and a biosensing device including the capillary driven microfluidic system are provided. The capillary driven microfluidic system includes: a first substrate comprising at least one microfluidic channel ending in an opening, and having, adjacent to the opening, a protruding element; and a second substrate comprising at least one open cavity. The at least one protruding element and the at least one cavity include at least one hydrophilic surface. In addition, the at least one protruding element and the at least one cavity may be adapted for engaging with one another for providing transfer of a fluid between the first substrate and the second substrate. A space between the at least one hydrophilic surface of the at least one protruding element and the at least one hydrophilic surface of the at least one cavity is provided, where the separation between said surfaces is such that capillary forces are generated on the fluid upon entering inside the space.

20 Claims, 6 Drawing Sheets

(56) References Cited

U.S. PATENT DOCUMENTS

2017/0239661 A1 8/2017 Berthier et al.

OTHER PUBLICATIONS

Temiz, Y., et al., "Lab-on-a-Chip Devices: How to Close and Plug the Lab?", Microelectronic Engineering, 2015, vol. 132, pp. 156-175.

* cited by examiner

PASSIVE FLUIDIC CONNECTION BETWEEN TWO HYDROPHILIC SUBSTRATES

CROSS REFERENCE

This application claims the benefit of priority from European Patent Application No. 19186465.1, filed Jul. 16, 2019, which is incorporated by reference in its entirety.

FIELD OF THE DISCLOSURE

The disclosure relates to the field of microfluidics. More specifically, the disclosure relates to a device and method to provide a hybrid microfluidics system, for instance in a biosensing device.

BACKGROUND OF THE DISCLOSURE

Packaging for silicon chips containing microfluidic structures currently lacks an accepted standard for connecting the silicon chip to the fluid inlets and outlets. Document "Lab-on-a-chip devices: How to close and plug the lab?" by Y. Temiz et al, Microelectronic Engineering 132 (2015) 156-175, discloses several interconnection possibilities based on, for example, reversible insertion of tubes into holes on the chip surface or edge, compression sealing, adhesives or magnetic rings or integration of microfluidic ports. These solutions are usually bulky. Moreover, if different subsystems (e.g. two platforms made with different materials) need to be combined, the combination usually employs specific connectors, valves and active pumps in order to facilitate fluid transfer. In particular, fluidic connection of a silicon chip to fluidic inlets and outlets has been applied mainly in pressure-driven microfluidics.

Packaging for microfluidics should not be neglected because it has a great impact on the cost, manufacturing and performances of the final product. Packaging is an important aspect of manufacture of "lab on a chip" (LOC) devices. However, the limited possibilities and the pumping requirements for combining different platforms make packaging of combined platforms difficult.

SUMMARY OF THE DISCLOSURE

It is an object of embodiments of the present disclosure to provide a system including a plurality of substrates, where the substrates can be interconnected to one another, and fluid can flow from one substrate to the other one, without the need of using pumps or active elements.

A packaged system can be obtained with a plurality of substrates with passive interconnections which allows to passively drive liquid from one substrate to another substrate.

In some embodiments, only capillary forces are needed to drive the liquid from one substrate to the other one.

The present disclosure provides a capillary driven microfluidic system. The system comprises:

- a first substrate comprising at least one microfluidic channel ending in an opening, and having, adjacent to the opening, a protruding element, and
- a second substrate comprising at least one open cavity, wherein the at least one protruding element and the at least one cavity comprise at least one hydrophilic surface.

The at least one protruding element and the at least one cavity are adapted for engaging with one another for providing transfer of a fluid between the first substrate and the second substrate. The system further comprises a space between the at least one hydrophilic surface of the at least one protruding element and the at least one hydrophilic surface of the at least one cavity, wherein the separation between said surfaces is such that capillary forces are generated on the fluid upon entering inside the space.

In embodiments of the present disclosure, reliable fluid transfer between two platforms can be obtained, even between platforms made of different materials, via capillary forces.

For a given liquid and given surfaces with given wetting properties with this liquid, dimensions can vary from few mms to lower values. For example, if a liquid is provided that wets a surface with a contact angle of 10°, a channel of 2 mm can create enough pressure to move an interface there. In some embodiment of the present disclosure, the separation between the at least one hydrophilic surface of the at least one protrusion and the at least one hydrophilic surface of the at least one cavity can be in the order of few hundreds of microns or lower, for example 500 microns or lower, for example 100 microns or lower, e.g. 10 microns or lower.

In some embodiment of the present disclosure, at least one stop can be included for providing physical contact between the first substrate and second substrate, so the stop abuts at least one substrate in a contact region, while providing a separation between the first substrate and second substrate outside said contact region.

The separation between the substrates in a region different from the stops and the engagement (e.g. the separation or gap between the surfaces containing the opening and cavity respectively) can be used to provide adhesive, e.g. glue or a double sided tape, easily and with no risk that the adhesive could contact the fluid. Thus, a wide range of adhesives, even hydrophobic ones, can be used with no risk of contact between the fluid and the adhesive.

The at least one stop, in some embodiments, can be an integral part of one or both substrates. In some embodiments of the present disclosure, the stop does not need to be attached to a substrate in a separate step, so its height can be carefully controlled. The stop can be provided at the same time as the substrate, for example by 3D printing. In addition, alignment of the stop can be automatically done for one of the substrates by providing the stop as an integral part of that substrate.

In some embodiment of the present disclosure, one or both of the substrates comprise alignment structures for fitting the substrates together and fixing the position with respect to each other in such way that the at least one protrusion of the first substrate can engage with the at least one cavity of the other substrate.

In embodiments of the present disclosure, good alignment can be provided, ensuring that the protrusions will engage the cavities. In embodiments, the space between the protrusion and the walls delimiting the cavity (e.g. the distance between the surface of the protrusion and the surface of the cavity) can be accurately controlled, avoiding clogging of fluid due to physical contact between the surfaces of the cavity walls and protrusion.

In some embodiment of the present disclosure, the connection between the at least one open cavity and the at least one microfluidic channel can be adapted to enhance contact between the fluid in the at least one microfluidic channel and the at least one protruding element.

In embodiments of the present disclosure, the fluidic contact between the microfluidic channel and the protrusion of the substrate can be ensured, for example by adding tapered structures.

In some embodiment of the present disclosure, one of the substrates comprises plastic.

In embodiments of the present disclosure, the substrate can be obtained easily, for example by molding a polymer, the polymer comprising e.g. a thermoplastic, or e.g. thermosetting polymer. For example 3D printed plastics can be used for molding or for providing 3D printed substrates.

In some embodiment of the present disclosure, at least one of the substrates comprises semiconductor material or glass.

In embodiments of the present disclosure, a semiconductor platform, such as a chip, e.g. silicon chip, can be packaged easily with a microfluidic platform.

In some embodiment of the present disclosure, the second substrate further comprises a microfluidic channel.

In embodiments of the present disclosure, capillary action may allow transfer of fluid between two microfluidic networks in different substrates.

In some embodiment of the present disclosure, the system further comprises a third substrate. The first substrate comprises a further protrusion or a further cavity, and the third substrate comprises a cavity for engaging the further protrusion of the first substrate or comprises a protrusion for engaging the further cavity of the first substrate.

In embodiments of the present disclosure, bridging between multiple substrates and/or multiple substrate types can be provided.

In some embodiments, the at least one microfluidic channel of the first substrate can be adapted to provide fluid to the second and third substrates. Optionally or additionally, the microfluidic channel of the first substrate may be adapted to provide fluidic connection (thus, to allow fluid transfer) between the second and third substrates, thereby bridging these substrates.

In some embodiments, the second and third substrates comprise semiconductor chips and the first substrate comprises a polymeric material.

In embodiments of the present disclosure, fluids can be provided to a plurality of semiconductor platforms in a compact way. Furthermore, (micro)fluidic coupling can be provided between two semiconductor platforms.

The capillary driven microfluidic system in accordance with embodiments of the present disclosure may be used in a biosensing device. The present disclosure also relates to such biosensing device.

Particular aspects of the disclosure are set out in the accompanying independent and dependent claims. Features from the dependent claims may be combined with features of the independent claims and with features of other dependent claims as appropriate and not merely as explicitly set out in the claims.

These and other aspects of the disclosure will be apparent from and elucidated with reference to the embodiment(s) described hereinafter.

Figure 1:
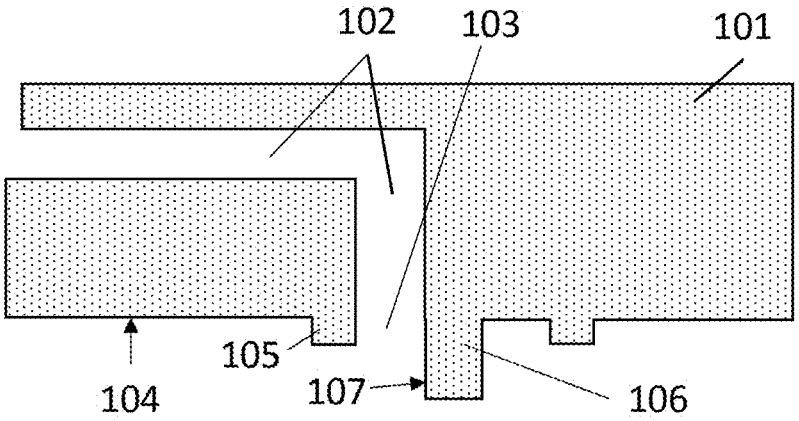
FIG. 1 illustrates a cross section of a representative substrate which may be used in embodiments of the present disclosure, the substrate including a cavity and a protrusion in fluid connection to a microfluidic channel.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

DETAILED DESCRIPTION OF ILLUSTRATIVE EMBODIMENTS

The present disclosure will be described with respect to particular embodiments and with reference to certain drawings but the disclosure is not limited thereto but only by the claims. The dimensions and the relative dimensions do not correspond to actual reductions to practice of the disclosure.

The terms first, second and the like in the description and in the claims, are used for distinguishing between similar elements and not necessarily for describing a sequence, either temporally, spatially, in ranking or in any other manner. It is to be understood that the terms so used are interchangeable under appropriate circumstances and that the embodiments of the disclosure described herein are capable of operation in other sequences than described or illustrated herein.

Moreover, the terms top, under and the like in the description and the claims are used for descriptive purposes and not necessarily for describing relative positions. It will be understood that the terms so used are interchangeable under appropriate circumstances and that the embodiments of the disclosure described herein are capable of operation in other orientations than described or illustrated herein.

The term "comprising", used in the claims, should not be interpreted as being restricted to the means listed thereafter; it does not exclude other elements or steps. It shall be interpreted as specifying the presence of the stated features, integers, steps or components as referred to, but does not preclude the presence or addition of one or more other features, integers, steps or components, or groups thereof. The term "comprising" therefore covers the situation where only the stated features are present and the situation where these features and one or more other features are present. Thus, the scope of the expression "a device comprising means A and B" should not be interpreted as being limited to devices consisting only of components A and B. It means that with respect to the present disclosure, the only relevant components of the device are A and B.

Reference throughout this specification to "one embodiment" or "an embodiment" means that a particular feature, structure or characteristic described in connection with the embodiment is included in at least one embodiment of the present disclosure. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the description of exemplary embodiments of the disclosure, various features of the disclosure are sometimes grouped together in a single embodiment, figure, or description thereof for the purpose of streamlining the disclosure and aiding in the understanding of one or more of the various disclosed aspects. This method of disclosure, however, is not to be interpreted as reflecting an intention that the claimed disclosure requires more features than are expressly recited in each claim. Rather, as the following claims reflect, disclosed aspects lie in less than all features of a single foregoing disclosed embodiment. Thus, the claims following the detailed description are hereby expressly incorporated into this detailed description, with each claim standing on its own as a separate embodiment of this disclosure.

Furthermore, while some embodiments described herein include some but not other features included in other embodiments, combinations of features of different embodiments are meant to be within the scope of the disclosure, and form different embodiments, as would be understood by those in the art. For example, in the following claims, any of the claimed embodiments can be used in any combination.

In the description provided herein, numerous specific details are set forth. However, embodiments of the disclosure may be practiced without these specific details. In other instances, well-known methods, structures and techniques have not been shown in detail in order not to obscure an understanding of this description.

In a first aspect, the present disclosure relates to a microfluidic substrate that includes at least one opening to transfer fluid in and/or out of the substrate. It further includes at least one protrusion for engaging a second substrate which has a corresponding cavity.

FIG. 1 shows a cross section of an exemplary embodiment of a substrate 101 including a microfluidic channel 102 which may e.g. bring a fluid towards an opening 103, for instance in a surface 104 of the substrate 101. The protrusion 106 can be sized so it can fit in an opening of a second substrate; or differently worded: the opening of the second substrate can be sized so that it can fit over and can be slightly larger than the protrusion 106, the dimensions of protrusion and second opening being such that capillary action between both can be made possible. The protrusion and the opening of the first substrate can be configured to ensure contact between liquid flowing in the microfluidic channel, on the one hand, and the protrusion, on the other hand.

The protrusion 106 may protrude from the surface 104 in combination with the opening 103 to the microfluidic channel 102 in the substrate 101; for example the protrusion may be near or adjacent to the opening 103, or the opening may completely surround the protrusion. However, the opening 103 does not necessarily have to be in the surface 104 of the substrate including the protrusion 106. In some embodiments, both the protrusion and the opening are combined, for example the protrusion 106 itself may include the opening to the microfluidic channel; for example, the opening may be a groove extending longitudinally in the protrusion.

Figure 4:
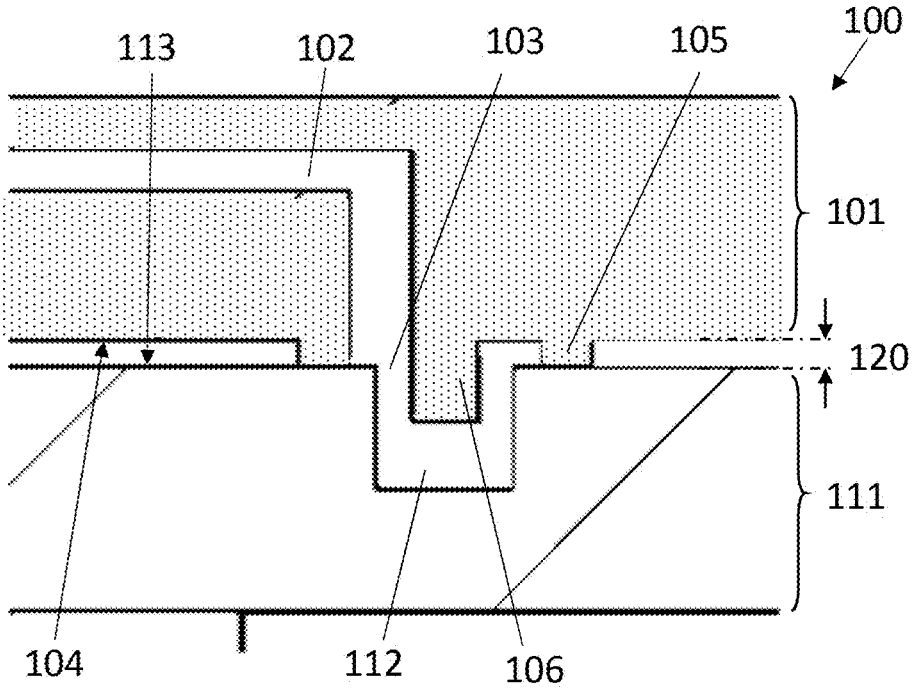
FIG. 4 illustrates a representative system including two substrates where flow of liquid can be passively provided, via capillary action, by the surfaces of the protrusion of one substrate and the cavity of the other substrate, in accordance with embodiments of the present disclosure.

The substrate 101 may include one or more stops 105 functioning as a spacer when the substrate 101 is arranged on a second substrate as in FIG. 4, the stop 105 being for providing space between the two substrates, e.g. in which space an adhesive layer can be provided. Moreover, it may provide tight closure so liquid does not spill when being transferred from the first substrate to the substrate arranged thereon.

Figure 2:
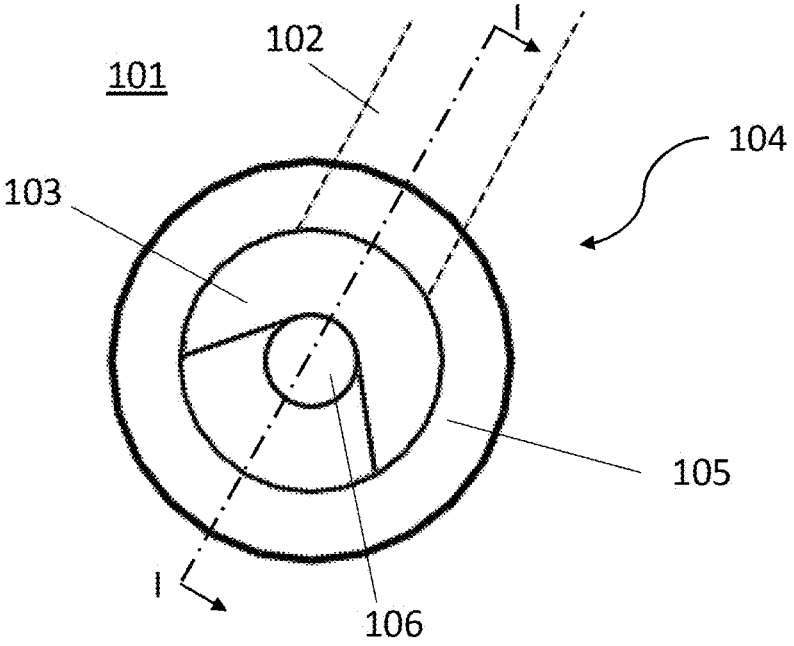
FIG. 2 illustrates a bottom view of the representative substrate of FIG. 1.

FIG. 2 is a bottom view of the substrate of which the cross section is schematized in FIG. 1. In fact, FIG. 1 illustrates schematically a section taken along the line I-I of FIG. 2.

The protrusion 106 can be located next to an opening 103, which partially surrounds the protrusion 106. The microfluidic channel 102 can be embedded within the material of the substrate 101, and it is shown delimited with dashed lines. In this particular example, the stop 105 can be a ring protruding a predetermined height from the surface 104 of the first substrate 101.

The protrusion 106 is shown as a cylindrical pillar. The present disclosure is not limited to the shape of the protrusion, other geometries may be included. Instead of a pillar, it may be a prism, a pyramid or cone, a semi-sphere, etc., which may be chosen depending on the fabrication techniques and limitations of these techniques, and depending on the shape of the cavity of the second substrate.

An opening 103, e.g. an open cavity in the substrate, allows direct fluidic contact between the microfluidic channel 102 and the protrusion 106.

Figure 3:
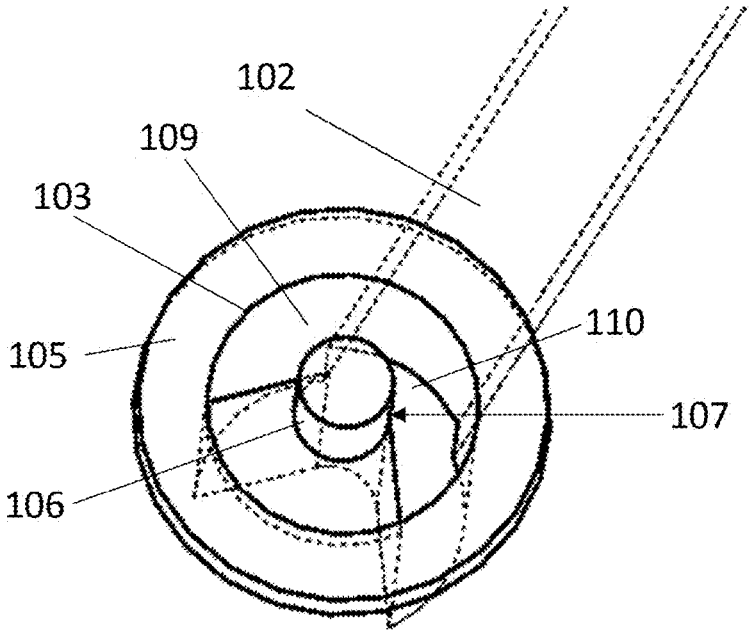
FIG. 3 illustrates a perspective view of the representative substrate shown in FIG. 2.

FIG. 3 shows a perspective view of the substrate of FIG. 2. The stop 105 is clearly shown as a ring protruding from the surface 104. The microfluidic channel 102 can be connected to the opening 103 via the portion 109 of the microfluidic channel. The portion 109 is shown as extending in the same direction as the protrusion 106; this direction may be different from the direction of the rest of the microfluidic channel 102. For example, the flow of liquid in the substrate may be parallel to the surface 104 within the microfluidic channel other than in the portion 109, while in the portion 109 the flow may become perpendicular to that surface 104.

The surfaces of the microfluidic channel 102 can be hydrophilic. At least one surface 107 (FIG. 1, FIG. 3) of the protrusion 106, usually the surface in direct physical contact with a surface of the channel, can also be hydrophilic. For example, the surfaces may be covered with a hydrophilic substance. In other embodiments, the material of the substrate 101 and the protrusion 106 (which may be made of the same material as the substrate 101, and may be part of it), can hydrophilic. When a liquid flowing through the microfluidic channel 102 contacts the surface 107 of the protrusion 106, the meniscus of the liquid (being a concave meniscus, due to the hydrophilicity of the surfaces) extends over the protrusion, increasing wetting. More in detail, the liquid can enter the portion 109 of the microfluidic channel through the aperture 110. Due to the hydrophilic character of the surfaces of the microfluidic channel, the fluid advances towards and extends over the protrusion 106. Hence, flow towards the opening 103 on the surface 104 can be provided, with no need of pumps, even if the majority of the microfluidic channel 102 or channels extends parallel to the surface 104.

Optionally, the opening, and/or the surface of the protrusion, and/or the surface of the microfluidic channel, and/or the surfaces or walls defining the portion 109 and/or the opening 103, may be adapted, e.g. shaped, or covered with a substance to improve liquid flow, for example to control the surface tension of the liquid, thus controlling the shape of the meniscus and forcing the meniscus of the liquid towards the protrusion, thereby ensuring wetting of the protrusion 106. In additional or alternative embodiments, a tapered structure can be placed in the opening 103.

In a further aspect, the present disclosure provides a system combining two substrates, both substrates containing a capillary-driven microfluidic network.

In a capillary-driven system, different capillary-driven sub-systems with different materials, surfaces, etc. may be combined, which makes it necessary to bridge the different sub-systems together. The present disclosure provides a system wherein the bridging can be done via a passive interconnection, using only capillary forces to drive the liquid from one component to the other one, with no need of active components (pumps, valves, etc.).

The first and second substrates comprise corresponding protrusion and cavity, which are assembled so that the protrusion engages the cavity. The fluid from one substrate can be transferred to the second substrate, by capillary forces, e.g. exclusively by capillary forces, when the protrusion and the cavity of the respective substrates are engaged to each other.

Even if the first and second substrates comprise different materials and surfaces (e.g. plastics and semiconductors), the present disclosure enables bridging them together via passive fluidic interconnection, using only capillary forces to drive the liquid from one substrate to the other one. No active pumps or valves are needed, so there is no need of external control units and energy sources. The present disclosure provides a robust system free of risk, or at least with a reduced risk, of mechanical failure (as no moving parts are needed). The surfaces may be relatively flat and easy to provide, with no need of complex etchings, or the like. For example, the protrusion and/or cavity do not need to comprise micropillar arrays, porous elements, wicks, or the like.

The system also shows simple assembly and operation. It can be compact, with no need of the extra space required by active components.

Due to the confinement of the liquid in the microfluidic channel, the surface tension of the liquid does not allow easy transfer of the liquid from one substrate to the other. The bonding and contact zones further impede proper wetting of the surfaces. This leads to an unreliable liquid transfer.

In embodiments of the present disclosure, the opening of the first substrate does not simply allow the liquid to pass to the cavity of the second substrate, but rather, the protrusion penetrating the second substrate promotes wetting of the hydrophilic surface of the cavity wall. The distances between the surfaces of the protrusion of one substrate and the cavity of the other substrate, as well as their hydrophilic character, ensures continuous capillary action of liquid from one substrate to the other.

FIG. 4 shows a cross section of an exemplary embodiment of a system 100 including a first substrate, e.g. top substrate 101 (a substrate, in accordance with the first aspect of the present disclosure, such as for instance a substrate as illustrated in FIG. 1 to FIG. 3) and a second substrate, e.g. bottom substrate 111. The top substrate 101 includes a microfluidic channel 102 which provides an opening 103 in that surface 104 of this top substrate that faces the second substrate 111. The top or first substrate 101 includes a protrusion 106, located next to the opening 103, such that a surface 107 of the protrusion 106 is an extension of a surface of the microfluidic channel 102. The protrusion 106, as in the particular embodiment of FIG. 2, may be a pillar protruding from the first substrate 101.

The second substrate 111 includes a cavity 112 in its surface 113, which can be adapted in shape, size and location so as to be able to engage the protrusion 106 of the first substrate 101. However, the engagement between the protrusion 106 and cavity 112 leaves enough space for allowing fluid flow between the first and second substrates 101, 111.

In some embodiments, the second substrate 111 comprises interacting elements such as analysis surfaces, active surfaces, sensors, etc. for interacting with the fluid in the cavity 112. In some embodiments, the second substrate 111 comprises a microfluidic channel connected to the cavity 112 (shown in FIG. 7). The cavity 112, and optionally also any microfluidic channel included in the second substrate 111, comprise hydrophilic surfaces. For example, in some embodiments, the second substrate 111 comprises or can be made of hydrophilic materials.

In some embodiments of the present disclosure, physical contact between the substrates 101, 111 can be provided via one or more stops 105, as explained with reference to FIG. 1 and FIG. 2. These stops 105 may be pieces separate from the substrate or, as shown in the present examples, the one or more stops 105 may be an integral part of (and protruding from) any or both of the substrates, e.g. shaped on the substrate surface. Providing the one or more stops 105 as integral part of the substrate also means that the stop can be automatically aligned which can be beneficial relative to providing a separate stop and having to align it with both substrates before attaching them. The location of the stops and the substrate on which the one or more stops are provided may depend on factors such as manufacturing, etc. For example, a plastics substrate can be molded providing the stops, whereas for a semiconductor substrate it requires etching and other more complex techniques. In practice, it may be convenient to have stops 105 protruding from the first substrate rather than from the second substrate, in view of the fact that another protruding element, namely protrusion 106, also needs provided on the first substrate.

The one or more stops provide a gap 120 between the first and second substrates 101, 111, for instance, to allow provision of an adhesive layer, e.g. a layer of glue or a double sided tape to assemble the two substrates 101, 111. The at least one stop 105 may surround the opening 103 and the pillar 106, beneficially providing closure in the contact zone between the substrates, so the fluid does not spread in the gap 120 between the substrates. If no stop 105 would be present, the junction between substrates might allow the fluid to reach the adhesive between the substrates, which sometimes is undesirable, e.g. if the adhesive is hydrophobic. The contact of the liquid with the hydrophobic adhesive would block the capillary action. The stop avoids occurrence of this effect.

FIG. 4 shows that the at least one stop 105 of the first substrate 101 contacts the surface 113 of the second substrate 111 and may also limit the depth of penetration of the pillar 106 into the cavity 112 of the second substrate 111.

The combination of sizes of the cavity 112 and the protrusion 106, together with the height of any stop 105, ensure sufficient spacing between the protrusion 106 and the walls delimiting the cavity, for allowing liquid flow to occur from one substrate to the other, including between the top of the protrusion 106 and the bottom of the cavity 112, if desired. In any case, the stop height should be such that good penetration of the protrusion in the cavity can be provided. For example, if the cavity 112 of the second substrate is provided directly in its flat surface 113 as shown in FIG. 4, the height of the stop 105 should be smaller than the height of the protrusion 106, both measured from the surface 104 of the first substrate 101.

In a system 100 in accordance with embodiments of the present disclosure, the first substrate 101 and second substrate 111 can be attached to each other. They can be attached in any suitable way. For example, adhesive can be used in the space between the surfaces 104, 113 of the first and second substrate, respectively, these surfaces facing each other, said space formed by the gap 120 (e.g. due to the stops 105). The adhesive is not applied in the cavity 112 or on the protrusion 106, and it does not need to be applied on the stop 105 either, so the stop 105 directly rests on the surface of the other substrate (surface 113 of the second substrate 111 if the stop 105 is provided on the first substrate 101, or surface 104 of the first substrate 101 if the stop is provided on the second substrate 111. As adhesive, glue can be used which is easy to provide. In other embodiments, a double-sided tape can be used as adhesive, which provides an adhesive layer with even thickness in an inexpensive way. For example, the thickness of the adhesive layer can be the same, within a predetermined error margin, as the height of the stops 105. Moreover, the use of double sided tape enables a fast assembly of the system.

Regardless of the type of adhesive used, the stop or stops 105 can improve the consistency of the size of the gap 120 between the substrates, ensuring both a spacing for introducing adhesive between the substrates and a good and effective bridging between substrates, so capillary forces are also enabled in the bridging part.

Figure 5:
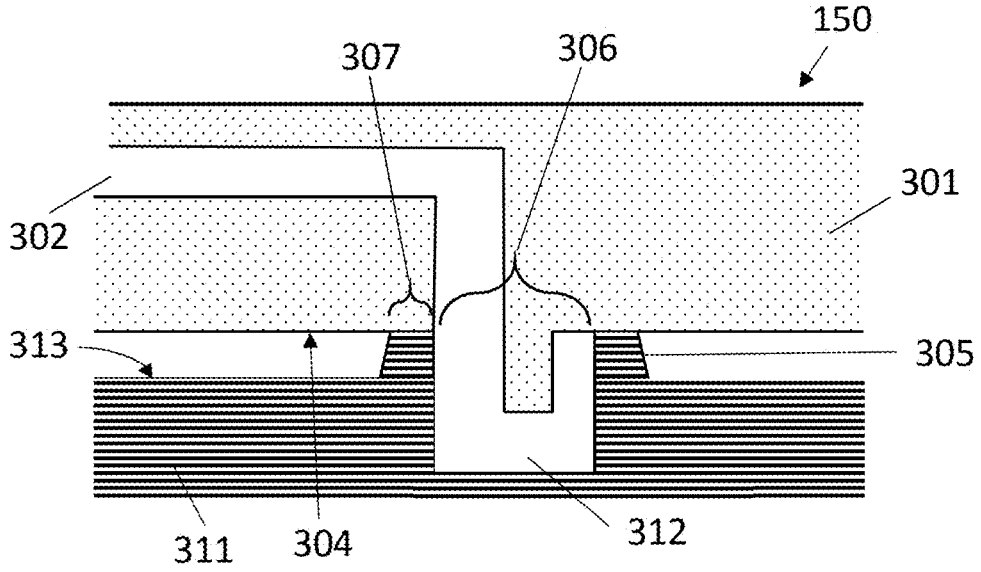
FIG. 5 illustrates a cross section of another embodiment of a representative system in accordance with the present disclosure, wherein the second substrate contains a risen edge on the surface, delimiting the opening of the cavity for receiving or engaging the protrusion of the first substrate.

However, the present disclosure is not limited to the stops 105 present on the first substrate, as illustrated in FIG. 4. The opening of the cavity 112 in the second substrate 111 may be delimited by risen edges. A system 150 including an example of such stops is shown in FIG. 5. For example, a truncated cone may be provided at the surface 313 of a second substrate 311. The top of the truncated cone 305 includes the opening 306 of the cavity 312 of the second substrate. The area 307 between the opening 306 and the corner between the top and the slope of the cone 305 may abut against a surface 304 of a first substrate 301 including a microfluidic channel 302. Thus, the conic structure acts as a stop 305 while being an integral part of the second substrate, for example. The stop in the first substrate 301 does not need to be provided, if so desired. This structure can be provided by 3D printing, etching, etc. The height of the stop 105, 305 may be enough to ensure abutting between the two substrates while providing enough gap for the presence of adhesive between the substrates.

Moreover, the stop or stops 105, 305 are optional, and other ways of attachment between the substrates can be envisaged with no need to leave a space between the first and second substrate other than the space necessary to provide capillary flow between the substrates.

In some embodiments, the microfluidic system is a packaged system. For example, it may be included in a package and covered in molding material. It may include preloaded chambers which may activate the capillary action and fluid movement upon actuation of the chambers. Such packaged systems may be part of a LOC.

Figure 6:
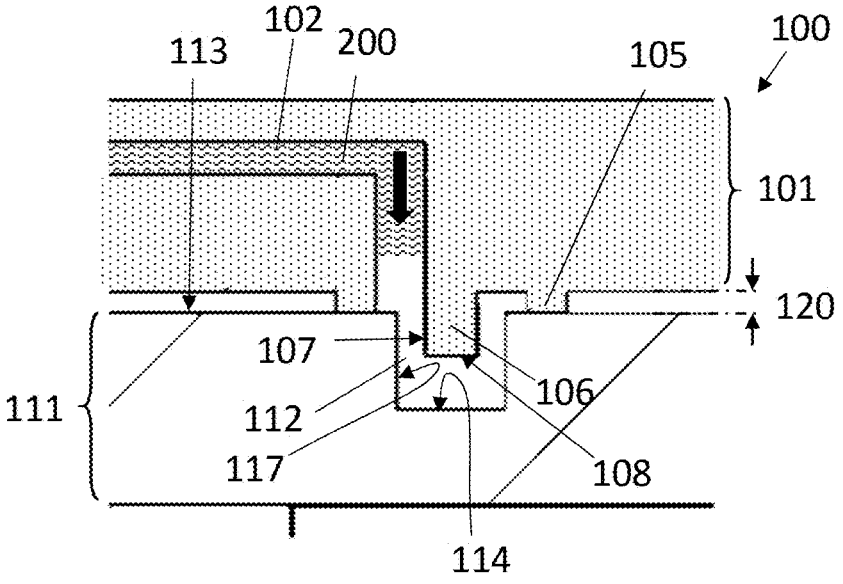
FIG. 6 illustrates the representative system of FIG. 4, including the motion of fluid through one channel.

FIG. 6 shows the flow (thick arrow) of a liquid 200 through the embedded microfluidic channel 102 of the first substrate 101 in the exemplary system 100 of FIG. 4. The surfaces 117, 114 of the lateral and bottom walls of the cavity 112 are indicated. At least the surface 117 of the lateral wall should be hydrophilic. The surface 114 of the bottom wall may also be hydrophilic.

Figure 7:
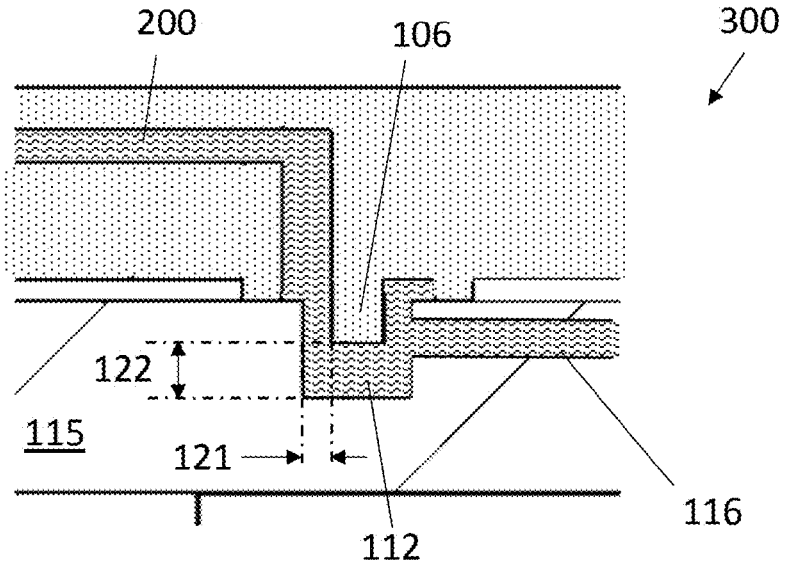
FIG. 7 illustrates the representative system of FIG. 4, including the motion of fluid through one channel in each substrate, via capillary action.

FIG. 7 shows a similar system 300, wherein the liquid 200 was completely transferred to a second substrate 115 including a microfluidic channel 116.

In the exemplary embodiment of FIG. 4, the cavity 112 engages loosely with the protrusion 106 of the first substrate 101, forming a capillary duct between the walls of the protrusion 106 and the walls delimiting the cavity. FIG. 7 shows the results of such engagement: the size (e.g. diameter) of the protrusion 106 is adapted to fit within the cavity 112, leaving enough space for fluid flow between the inner wall or side walls or surface 117 of the cavity 112 and the outer wall or side walls 107 of said protrusion 106, but the distance 121 is not so large that surface tension impedes wetting.

Figure 8:
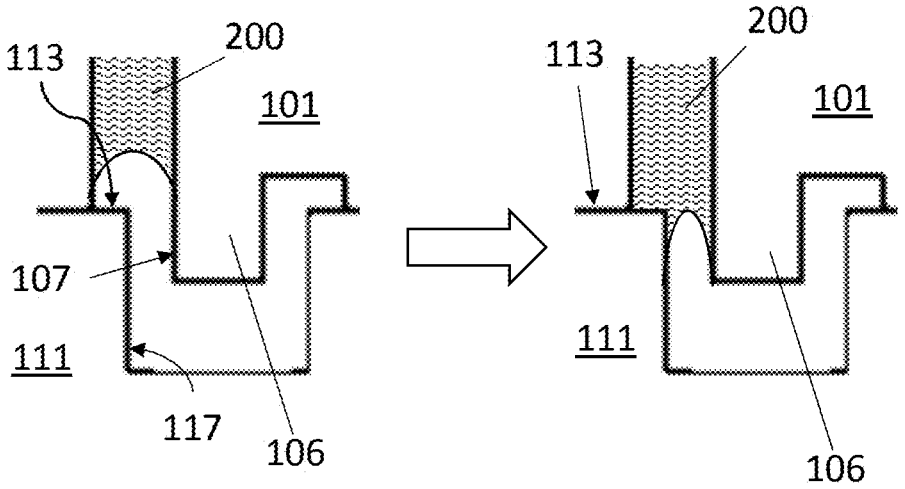
FIG. 8 illustrates the meniscus of a fluid upon transitioning from the first substrate to the second substrate in a system in accordance with embodiments of the present disclosure.

FIG. 8 shows two drawings where the liquid 200 is transferred from one substrate 101 to the other 111. The interaction of the liquid 200 with the surface 107 of the protrusion 106 in one substrate 101 and the surface 117 of the inner walls of the cavity in the other substrate 111 provides the required wetting and the resulting capillary action. Additionally, the liquid 200 may also interact with any other surface of the second substrate 111 simultaneously with the protrusion 106; for example before entering the cavity the liquid may contact the top surface 113 of the second substrate 111. The absence of hydrophobic compounds in the junction between the substrate (e.g. hydrophobic glue), e.g. thanks to the presence of the stops 105, allows a continuous wetting of hydrophilic surfaces and therefore liquid transfer between substrates.

In some embodiments, the distance 122 between the bottom surface 114 of the cavity and the extremity surface 108 of the protrusion 106 (shown in FIG. 6 and FIG. 7) also allows capillary action by not allowing the liquid surface tension to take over while keeping a wetting meniscus profile. This allows to completely fill, with liquid, the space between the protrusion 106 and the walls delimiting the cavity 112, if required.

In some embodiments of the present disclosure, as in the system 300 shown in FIG. 7, the second substrate 115 may comprise a microfluidic channel 116, which may be part of a microfluidic network, in fluid connection to the cavity 112. Hence, capillary action can be used to transfer fluid between two microfluidic networks in two substrates which may be different from one another other, for instance different in materials.

The cavity 112 and/or the protrusion 106 may be adapted (e.g. in shape and/or size; for example, their distances may be adapted) to ensure good wetting of the protrusion and the cavity surfaces to allow fluid transfer to the microfluidic channel 116 in the second substrate 115. The cavity 112 does not need to be cylindrical. The position of the microfluidic channel 116 relative to the protrusion 106 may be also adapted to reduce liquid surface tension when the fluid starts wetting the microfluidic channel 116, taking into account the shape of the meniscus, etc. This can ensure the penetration of the fluid into the microfluidic channel 116.

Figure 9:
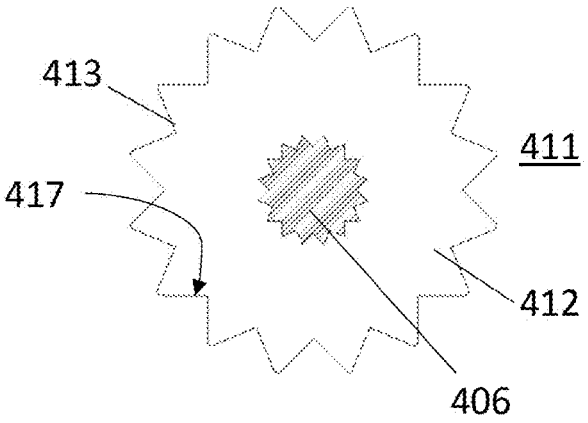
FIG. 9 illustrates a cross section of a representative system showing a cavity in a second substrate, the cavity with grooves or texturization for promoting wetting, and engaging a protrusion of a first substrate, in the example illustrated also with grooves or texturization for promoting wetting, in accordance with embodiments of the present disclosure.

Regarding the wetting of the cavity and protrusion, for example, FIG. 9 shows a section of a second substrate 411 including a cavity 412. The cavity 412 can be engaging a protrusion 406 of a first substrate. The cavity 412, in the embodiment illustrated, presents structures 413, such as grooves or textures, on its side wall 417, which promote flow of liquid by capillary flow. It may also present structures on the bottom surface (not shown) of the cavity 412.

In embodiments of the present disclosure, the protrusion may be a protrusion 106 as shown in FIG. 3, combined with a cavity 412 with structures as shown in FIG. 9. For example, the protrusion 106 may be cylindrical, the present disclosure not being limited thereto. It may have smooth surfaces 107, as long as these surfaces are hydrophilic. In embodiments of the present disclosure, such as the particular embodiment shown in FIG. 9, the protrusion 406 may comprise microstructures for promoting flow of liquid by capillary forces. For example, it may be textured, include grooves, or the like. Said textured protrusion 406 may be combined with a cavity with smooth surfaces (as long as these surfaces are hydrophilic) or, as shown in FIG. 9, with a textured or grooved wall 417 as explained earlier.

The present disclosure allows combination of several substrates of different types, materials and function, while still providing passive interconnections for passively transferring or driving liquid from one substrate to the other.

In some embodiments, one or both substrates may be a microfluidic substrate, e.g. comprising polymers, methacrylate, or other materials suitable for microfluidics. For example, it may comprise thermoplastics, thermosetting polymers, e.g. 3D printed polymeric substrates, etc. In some embodiments, one or both substrates may comprise other materials such as glass, or semiconductor, e.g. silicon substrate.

In some embodiments, the system comprises two substrates with similar function and/or material composition. For example, both may be microfluidic platforms. In other embodiments, the system 100 is a hybrid system, e.g. the substrates have different applications, e.g. the first substrate may be a microfluidic platform and the second may be a sensor chip; for example the first substrate may be a plastic substrate and the second a semiconductor substrate.

The present disclosure is not limited to those combinations. For example, interconnection can be provided in accordance with embodiments of the present disclosure between a polymeric (plastic) substrate and a glass substrate. In yet further embodiments, one of the substrates may be glass and the other a semiconductor substrate, e.g. silicon substrate, for example including sensors or the like.

The present disclosure may provide a microfluidic system with passive fluidic connection allowing fluid transfer via capillary forces with any combination of substrates.

The cavities, protrusions and any microfluidic channels of each substrate can have at least the surface covered with or made of hydrophilic material. For example, the substrates may be made of hydrophilic material, such as hydrophilic UV curable polymers, silicon, etc.

Additionally, the first and second substrates, and the relative positions of their microfluidic channels with the cavity and protrusion surfaces, may be adapted to provide a reversible passive fluidic interconnection. Fluid may be transferred from the first substrate to the second, and vice-versa, from the second substrate to the first, by allowing good contact and wetting of the fluid with the walls of the protrusion and the cavity upon entering the cavity and upon exiting it, in both directions of the liquid flow (upstream and downstream).

The size and/or shape of the microchannels should be adapted to provide enough pressure for the capillary forces to take place. This also holds for the bridging between the substrates. The dimensions, including relative gap sizes and distances between the protrusion 106 and the walls delimiting the cavity 112 should be of the order of few millimeters to lower values, for instance hundreds of microns, for example few hundreds of microns only. Suitable dimensions are determined by the type of liquid used, the surfaces and their wetting properties with this liquid. For example, if a liquid is wetting a surface with a contact angle of 10°, a channel of 2 mm creates enough pressure to move an interface there. For, for instance, high purity water (HPW) and surfaces leading to contact angles around 60° with HPW, channels with dimensions lower than 500 μm can be used to generate enough capillary forces to obtain a capillary flow. For a given liquid, different capillary forces can be obtained and controlled, by controlling the distance between the protrusion and cavity walls and by tuning the wetting properties of the given liquid with the surfaces of the substrates. The minimum distance may be very small, for example it may be in the order of the alignment error between the two substrates, under 500 μm, e.g. under 100 μm.

In order to achieve this accurate control, one of the substrates may include alignment or self-alignment structures for receiving the other substrate, for example one or more slots for receiving the edges of the other substrate. In some embodiments, both substrates may comprise alignment structures (e.g. a bolt in one substrate and a hole or nut on the other substrate for receiving the bolt, etc.).

Figure 10:
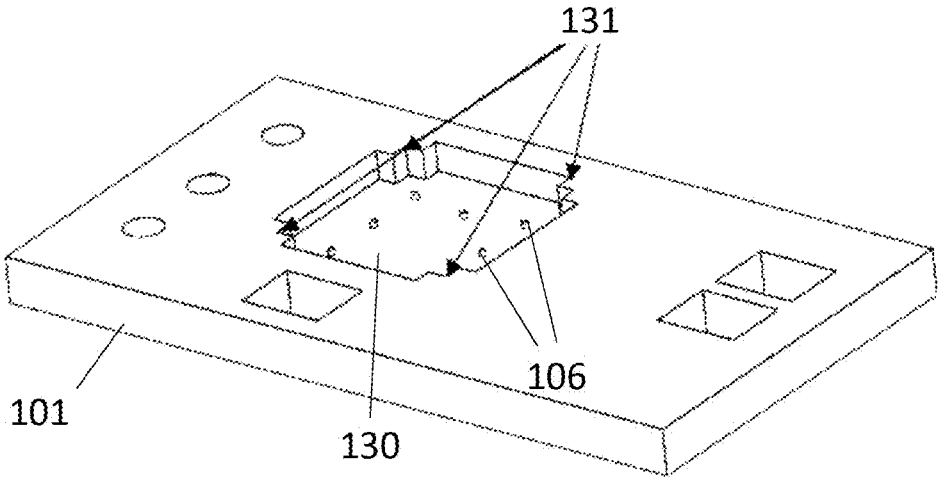
FIG. 10 illustrates a perspective view of a representative substrate including alignment elements to receive and align a further substrate for forming a system in accordance with embodiments of the present disclosure.

FIG. 10 shows a first substrate 101, e.g. including a plurality of protrusions 106 in a depressed or lowered area 130 of the first substrate. However, although not illustrated, this substrate could additionally or alternatively include cavities 112. A second substrate can be inserted in the lowered area of this first substrate. The second substrate can then comprise cavities mating (in location, size and shape as explained above) to the protrusions on the first substrate, and/or, in the alternative embodiments, protrusions mating to the cavities in the first substrate. As the area and shape of the second substrate can be known, the lowered area of the first substrate can be profiled and/or shaped to guide the insertion of the second substrate, providing good fitting and good alignment between the first and second substrates, and accurate engagement between the protrusion(s) and the cavity/cavities.

In particular, the exemplary substrate 101 of FIG. 10 includes alignment structures 131 being shaped corners to tightly fit the vertices of a second substrate, e.g. a silicon chip including a microfluidic network. Optionally, further alignment structures may be present in the second substrate, for fitting the alignment structures in the first substrate. Passive alignment such as the self-alignment structures mentioned earlier, or optically aligning marks on the substrate, can be used, as well as active alignment, for example using a visualization method coupled to a transducer for moving the relative position of the substrates. For example a camera (standard or infrared for non-transparent material) could be coupled to a moving arm, in order to position one substrate in front of the other and then attach them together.

Additionally, the lowered area 130 in the first substrate 101 can have a depth adapted to the thickness of a second substrate suitable for combination with the first substrate, so they form a system wherein the second substrate can be flush with the first substrate. A good, flush packaging profile can be obtained.

Figure 11:
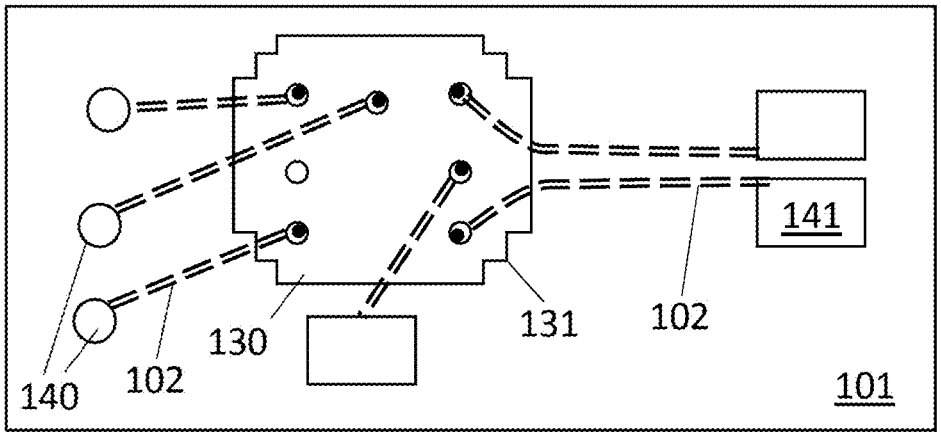
FIG. 11 illustrates the top view, showing the embedded microfluidic channels as dashed lines, of the substrate of FIG. 10.

FIG. 11 shows the top view of the substrate 101 of FIG. 10, where the microfluidic channels 102 embedded within the material of the substrate 101 are also shown, as dashed lines. The first substrate 101 may comprise inlets 140 and outlets 141 for introducing and removing, respectively, fluid from the microfluidic channels 102. For assisting the removal, for example, the outlets 141 may optionally comprise paper pumps or the like.

Fluid may be introduced via inlets 140 into the substrate through the microfluidic channels 102, which via capillary forces can be transferred to a second substrate 111 (not illustrated in FIG. 11) attached to the first substrate 101 (as shown in FIG. 4, FIG. 6 and FIG. 7), via the mating engaging protrusions 106 and cavities 112. Then, after processing of the fluid (e.g. analysis, separation or any other suitable process), the fluid may enter again into the first substrate through a further cavity and protrusion, and be removed from the system through the outlets 141 of the first substrate.

In some embodiments, the at least one stop 105 is a single stop enclosing an area of the substrate which contains the pillar 106 and the orifice opening 103, as also shown in FIG. 2.

In existing devices, the introduction of fluids (samples, buffers, etc.) in a semiconductor substrate, for example in a sensor chip, can be done by pipetting. One disadvantage thereof is, for example, that no buffer packs can be installed in such semiconductor platforms. The present disclosure allows combining buffer packs with semiconductor platforms. In embodiments of the present disclosure, the system includes buffer packs in a first substrate (being e.g. a plastic substrate, for example a 3D printed substrate) in fluid connection to a second substrate (e.g. a semiconductor substrate, for example a sensor chip) by capillary forces, without valves or pumps or the like. Hence a sensor chip or a packaged sensor chip can be provided with the functionality of buffer packs.

In some embodiments of the present disclosure, the system may include three substrates, for example two substrates of the same kind and a third of a different kind, or the three substrates of the same kind, or each substrate of a different kind.

Figure 12:
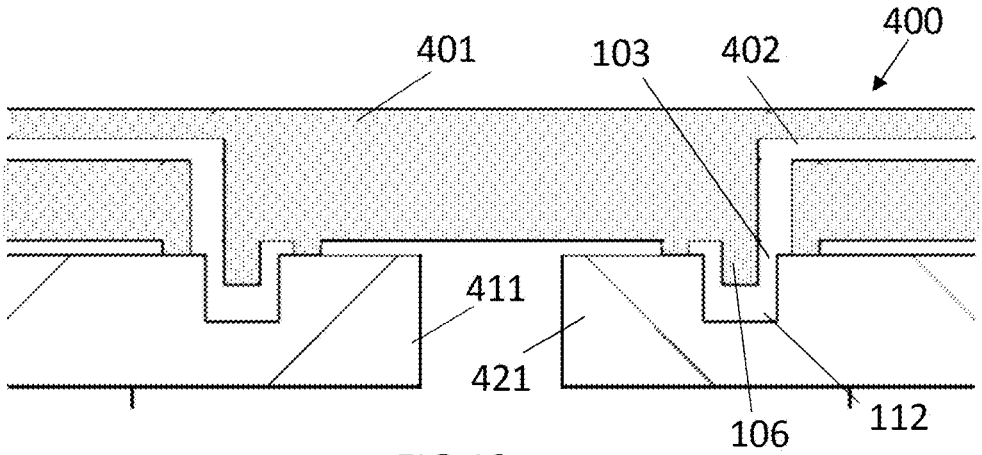
FIG. 12 illustrates a representative system in accordance with embodiments of the present disclosure, including three substrates, two of which are connected to, and can receive fluid from, the first substrate including a microfluidic channel.
Figure 13:
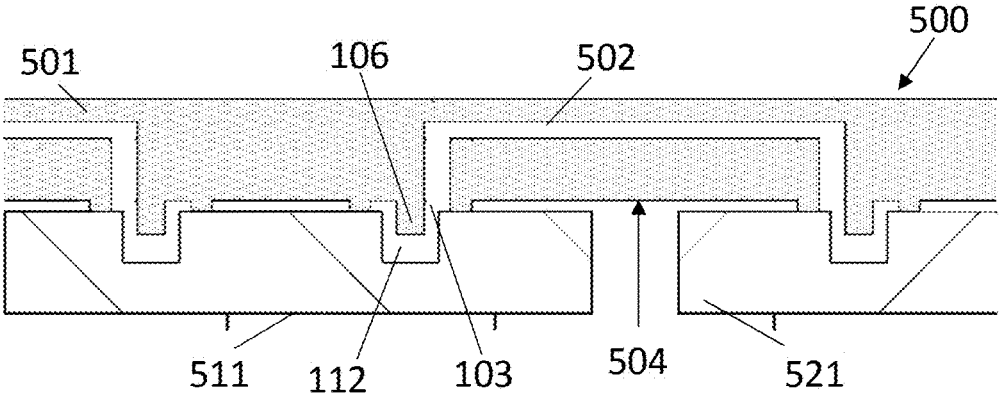
FIG. 13 illustrates a representative system in accordance with embodiments of the present disclosure, including three substrates, where the first substrate provides a bridging microfluidic channel for transferal of fluids between the other two substrates.

For example, the substrates may combine a microfluidic platform, a sensing substrate (e.g. sensor chip), a mixing platform or platform for providing chemical analysis, etc. For example, FIG. 12 and FIG. 13 show a cross section of a system 400, 500 including three substrates. In particular, the system shown in FIG. 12 includes a first substrate 401 which may be a microfluidic substrate and may be attachable or attached to two further substrates 411, 421, e.g. sensor chips, the attachment of each including an engagement system of cavity and protrusion as shown in FIG. 4. The at least one microfluidic channel 402 of the first substrate 401 may be routed and adapted to transfer fluid to the second and third substrates 411, 421.

In particular, a microfluidic platform, e.g. a polymeric 3D formed substrate, may serve as a microfluidic bridge between two further platforms, e.g. two semiconductor platforms, for instance two chips connected to the microfluidic platform. In particular, the system 500 shown in FIG. 13 includes a microfluidic platform 501 with at least one microfluidic channel 502 which may allow bridging fluid between two further platforms 511, 521. The further platforms 511, 521 may for example be connected to the same surface 504 of the microfluidic platform 501 as in the example of FIG. 12.

This allows a highly compact microfluidic system which allows microfluidic transfer and bridging between different platforms without the need of pumps or the like in the microfluidic bridging platform.

In embodiments of the present disclosure, a combination of both functionalities explained with reference to FIG. 12 and FIG. 13 can be readily provided. Thus, the first substrate may be connected and provide fluid to the other substrates, to bridge the second and third substrates to allow fluid transfer between them, or to provide fluid to one or both second and third substrates and bridge them to allow fluid transfer between them.

Thus, a system with multiple interconnected microfluidic substrates and/or chips can be provided, where one of the platforms may further provide liquid (e.g. liquid samples, buffer, etc.) to these further (e.g. semiconductor) platforms, and/or allow liquid transfer between these further (e.g. semiconductor) platforms.

The capillary driven microfluidic system in accordance with embodiments of the present disclosure may be implemented in a biosensing device. A biosensing device is an analytical device used to detect presence (or absence) of specific analytes. A biosensing device may be used in a wide range of applications ranging from clinical applications, for instance for diagnostics, through to environmental and agricultural applications.

The invention claimed is:

1. A capillary driven microfluidic system, the system comprising:

a first substrate comprising at least one microfluidic channel ending in an opening and at least one protruding element adjacent to the opening; and a second substrate comprising at least one open cavity, wherein the at least one protruding element and the at least one open cavity each comprise at least one hydrophilic surface, wherein the at least one protruding element and the at least one open cavity are adapted for engaging with one another for providing transfer of a fluid from the opening towards an outer surface of the at least one protruding element of the first substrate to the at least one open cavity of the second substrate via capillary forces, wherein a space is present between the at least one hydrophilic surface of the at least one protruding element and the at least one hydrophilic surface of the at least one open cavity, and wherein a separation between the at least one hydrophilic surface of the at least one protruding element and the at least one hydrophilic surface of the at least one open cavity is such that the capillary forces are generated on the fluid upon entering inside the space.

2. The system of claim 1, wherein the separation between the at least one hydrophilic surface of the at least one protruding element and the at least one hydrophilic surface of the at least one open cavity is 500 microns or lower.

3. The system of claim 1, wherein the separation between the at least one hydrophilic surface of the at least one protruding element and the at least one hydrophilic surface of the at least one open cavity is 100 microns or lower.

4. The system of claim 1, wherein the separation between the at least one hydrophilic surface of the at least one protruding element and the at least one hydrophilic surface of the at least one open cavity is 10 microns or lower.

5. The system of claim 1, further comprising at least one stop for providing physical contact between the first substrate and second substrate in a contact region while providing a separation between the first substrate and second substrate outside the contact region.

6. The system of claim 5, wherein the at least one stop is an integral part of the first substrate, the second substrate or both the first and second substrates.

7. The system of claim 1, wherein the first substrate, the second substrate or both the first and second substrates comprise alignment structures for fitting the substrates together and fixing a position with respect to each other in such way that the at least one protruding element of the first substrate can engage with the at least one open cavity of the second substrate.

8. The system of claim 1, wherein a connection between the at least one open cavity and the at least one microfluidic channel is adapted to enhance contact between the fluid in the at least one microfluidic channel and the at least one protruding element.

9. The system of claim 1, wherein one of the first or second substrates comprises plastic.

10. The system of claim 1, wherein at least one of the first or second substrates comprises semiconductor material or glass.

11. The system of claim 1, wherein the second substrate further comprises a microfluidic channel.

12. The system of claim 1, further comprising a third substrate, wherein the first substrate comprises at least a further protrusion or a further open cavity, and the third substrate comprises an open cavity for engaging the further protrusion of the first substrate or comprises a protrusion for engaging the further open cavity of the first substrate.

13. The system of claim 12, wherein the at least one microfluidic channel of the first substrate is adapted to provide fluid to the second and third substrates.

14. The system of claim 12, wherein the at least one microfluidic channel of the first substrate is adapted to provide fluidic connection between the second and third substrates.

15. The system of claim 13, wherein the at least one microfluidic channel of the first substrate is adapted to provide fluidic connection between the second and third substrates.

16. The system of claim 12, wherein the second and third substrates comprise semiconductor chips and the first substrate comprises a polymeric material.

17. The system of claim 14, wherein the second and third substrates comprise semiconductor chips and the first substrate comprises a polymeric material.

18. The system of claim 1, wherein the first substrate further comprises a buffer pack in fluid communication with the second substrate.

19. The system of claim 18, wherein the first substrate is a plastic substrate and the second substrate is a sensor chip.

20. A biosensing device comprising the capillary driven microfluidic system in accordance with claim 1.

* * * * *